US007663051B2

(12) United States Patent
Kamath et al.

(10) Patent No.: US 7,663,051 B2
(45) Date of Patent: Feb. 16, 2010

(54) AUDIO PROCESSING HARDWARE ELEMENTS

(75) Inventors: Nidish Kamath, Placentia, CA (US); Eddie L. T. Choy, Carlsbad, CA (US); Prajakt Kulkarni, San Diego, CA (US); Samir K Gupta, San Diego, CA (US); Stephen Molloy, San Diego, CA (US); Suresh Devalapalli, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 2 days.

(21) Appl. No.: 12/042,181

(22) Filed: Mar. 4, 2008

(65) Prior Publication Data

US 2008/0229919 A1 Sep. 25, 2008

Related U.S. Application Data

(60) Provisional application No. 60/896,462, filed on Mar. 22, 2007.

(51) Int. Cl.
*G10H 1/00* (2006.01)

(52) U.S. Cl. ..... 84/626; 84/662; 381/61

(58) Field of Classification Search ..... 84/626–633, 84/662–665; 381/61–63
See application file for complete search history.

(56) References Cited

U.S. PATENT DOCUMENTS

| | | | | | |
|---|---|---|---|---|---|
| 4,128,032 | A * | 12/1978 | Wada et al. | ..... | 84/604 |
| 4,915,007 | A * | 4/1990 | Wachi et al. | ..... | 84/622 |
| 5,091,951 | A * | 2/1992 | Ida et al. | ..... | 381/63 |
| 5,109,419 | A * | 4/1992 | Griesinger | ..... | 381/63 |
| 5,357,048 | A * | 10/1994 | Sgroi | ..... | 84/645 |
| 5,526,431 | A * | 6/1996 | Shioda | ..... | 381/61 |
| 5,596,159 | A * | 1/1997 | O'Connell | ..... | 84/622 |
| 5,635,658 | A * | 6/1997 | Kondo et al. | ..... | 84/626 |
| 5,719,346 | A * | 2/1998 | Yoshida et al. | ..... | 84/631 |
| 5,741,992 | A * | 4/1998 | Nagata | ..... | 84/631 |
| 5,744,741 | A * | 4/1998 | Nakajima et al. | ..... | 84/622 |
| 5,917,917 | A * | 6/1999 | Jenkins et al. | ..... | 381/63 |
| 6,023,018 | A * | 2/2000 | Iwase | ..... | 84/655 |
| 6,054,646 | A * | 4/2000 | Pal et al. | ..... | 84/608 |
| 6,327,367 | B1 * | 12/2001 | Vercoe et al. | ..... | 381/61 |
| 6,534,700 | B2 * | 3/2003 | Cliff | ..... | 84/603 |
| 7,423,214 | B2 * | 9/2008 | Reynolds et al. | ..... | 84/612 |
| 2004/0099128 | A1 * | 5/2004 | Ludwig | ..... | 84/662 |
| 2007/0137465 | A1 * | 6/2007 | Lindemann | ..... | 84/626 |
| 2007/0137466 | A1 * | 6/2007 | Lindemann | ..... | 84/626 |

* cited by examiner

*Primary Examiner*—David S. Warren
(74) *Attorney, Agent, or Firm*—Espartaco Diaz Hidalgo

(57) ABSTRACT

This disclosure describes techniques that make use of a plurality of hardware elements that operate simultaneously to service synthesis parameters generated from one or more audio files, such as musical instrument digital interface (MIDI) files. In one example, a method comprises storing audio synthesis parameters generated for one or more audio files of an audio frame, processing a first audio synthesis parameter using a first audio processing element of a hardware unit to generate first audio information, processing a second audio synthesis parameter using a second audio processing element of the hardware unit to generate second audio information, and generating audio samples for the audio frame based at least in part on a combination of the first and second audio information.

50 Claims, 5 Drawing Sheets

AUDIO PROCESSING HARDWARE ELEMENTS

RELATED APPLICATIONS

Claim of Priority Under 35 U.S.C. §119

The present Application for Patent claims priority to Provisional Application No. 60/896,462 entitled "AUDIO PROCESSING HARDWARE ELEMENTS" filed Mar. 22, 2007, and assigned to the assignee hereof and hereby expressly incorporated by reference herein.

TECHNICAL FIELD

This disclosure relates to audio devices and, more particularly, to audio devices that generate audio output based on audio formats such as musical instrument digital interface (MIDI).

BACKGROUND

Musical Instrument Digital Interface (MIDI) is a format for the creation, communication and playback of audio sounds, such as music, speech, tones, alerts, and the like. A device that supports the MIDI format may store sets of audio information that can be used to create various "voices." Each voice may correspond to a particular sound, such as a musical note by a particular instrument. For example, a first voice may correspond to a middle C as played by a piano, a second voice may correspond to a middle C as played by a trombone, a third voice may correspond to a D# as played by a trombone, and so on. In order to replicate the sounds played by various instruments, a MIDI compliant device may include a set of information for voices that specify various audio characteristics, such as the behavior of a low-frequency oscillator, effects such as vibrato, and a number of other audio characteristics that can affect the perception of different sounds. Almost any sound can be defined, conveyed in a MIDI file, and reproduced by a device that supports the MIDI format.

A device that supports the MIDI format may produce a musical note (or other sound) when an event occurs that indicates that the device should start producing the note. Similarly, the device stops producing the musical note when an event occurs that indicates that the device should stop producing the note. An entire musical composition may be coded in accordance with the MIDI format by specifying events that indicate when certain voices should start and stop. In this way, the musical composition may be stored and transmitted in a compact file format according to the MIDI format.

MIDI is supported in a wide variety of devices. For example, wireless communication devices, such as radiotelephones, may support MIDI files for downloadable ringtones or other audio output. Digital music players, such as the "iPod" devices sold by Apple Computer, Inc and the "Zune" devices sold by Microsoft Corp. may also support MIDI file formats. Other devices that support the MIDI format may include various music synthesizers such as keyboards, sequencers, voice encoders (vocoders), and rhythm machines. In addition, a wide variety of devices may also support playback of MIDI files or tracks, including wireless mobile devices, direct two-way communication devices (sometimes called walkie-talkies), network telephones, personal computers, desktop and laptop computers, workstations, satellite radio devices, intercom devices, radio broadcasting devices, hand-held gaming devices, circuit boards installed in devices, information kiosks, video game consoles, various computerized toys for children, on-board computers used in automobiles, watercraft and aircraft, and a wide variety of other devices.

A number of other types of audio formats, standards and techniques have also been developed. Other examples include standards defined by the Motion Pictures Expert Group (MPEG), windows media audio (WMA) standards, standards by Dolby Laboratories, Inc., and quality assurance techniques developed by THX, ltd., to name a few. Moreover, many audio coding standards and techniques continue to emerge, including the digital MP3 standard and variants of the MP3 standard, such as the advanced audio coding (AAC) standard used in "iPod" devices. Various video coding standards may also use audio coding techniques, e.g., to code multimedia frames that include audio and video information.

SUMMARY

In general, this disclosure describes techniques for processing audio files. The techniques may be particularly useful for playback of audio files that comply with the musical instrument digital interface (MIDI) format, although the techniques may be useful with other audio formats, techniques or standards. As used herein, the term MIDI file refers to any audio information that contains at least one audio track that conforms to the MIDI format. According to this disclosure, techniques make use of a plurality of hardware elements that operate simultaneously to service various synthesis parameters generated from one or more audio files, such as MIDI files.

In one aspect, this disclosure provides a method comprising storing audio synthesis parameters generated for one or more audio files of an audio frame, processing a first audio synthesis parameter using a first audio processing element of a hardware unit to generate first audio information, processing a second audio synthesis parameter using a second audio processing element of the hardware unit to generate second audio information, and generating audio samples for the audio frame based at least in part on a combination of the first and second audio information.

In another aspect, this disclosure provides a device comprising a memory that stores audio synthesis parameters generated for one or more audio files of an audio frame, and a hardware unit that generates audio samples for the audio frame based on the audio synthesis parameters. The hardware unit includes a first audio processing element that generates first audio information based on a first audio synthesis parameter, and a second audio processing element that generates second audio information based on a second audio synthesis parameter, wherein the hardware unit generates the audio samples based at least in part on a combination of the first and second audio information.

In another aspect, this disclosure provides a device comprising means for storing audio synthesis parameters generated for one or more audio files of an audio frame, means for processing a first audio synthesis parameter to generate first audio information, means for processing a second audio synthesis parameter to generate second audio information, and means for generating audio samples for the audio frame based at least in part on a combination of the first and second audio information.

In another aspect, this disclosure provides a computer-readable medium comprising instructions that upon execution cause one or more processors to store audio synthesis parameters generated for one or more audio files of an audio frame, process a first audio synthesis parameter using a first audio processing element of a hardware unit to generate first audio information, process a second audio synthesis parameter using a second audio processing element of the hardware unit to generate second audio information, and generate audio samples for the audio frame based at least in part on a combination of the first and second audio information.

In another aspect, this disclosure provides a circuit configured to store audio synthesis parameters generated for one or more audio files of an audio frame, process a first audio synthesis parameter using a first audio processing element of a hardware unit to generate first audio information, process a second audio synthesis parameter using a second audio processing element of the hardware unit to generate second audio information, and generate audio samples for the audio frame based at least in part on a combination of the first and second audio information.

The details of one or more aspects of this disclosure are set forth in the accompanying drawings and the description below. Other features, objects, and advantages will be apparent from the description and drawings, and from the claims.

DETAILED DESCRIPTION

Figure 1:
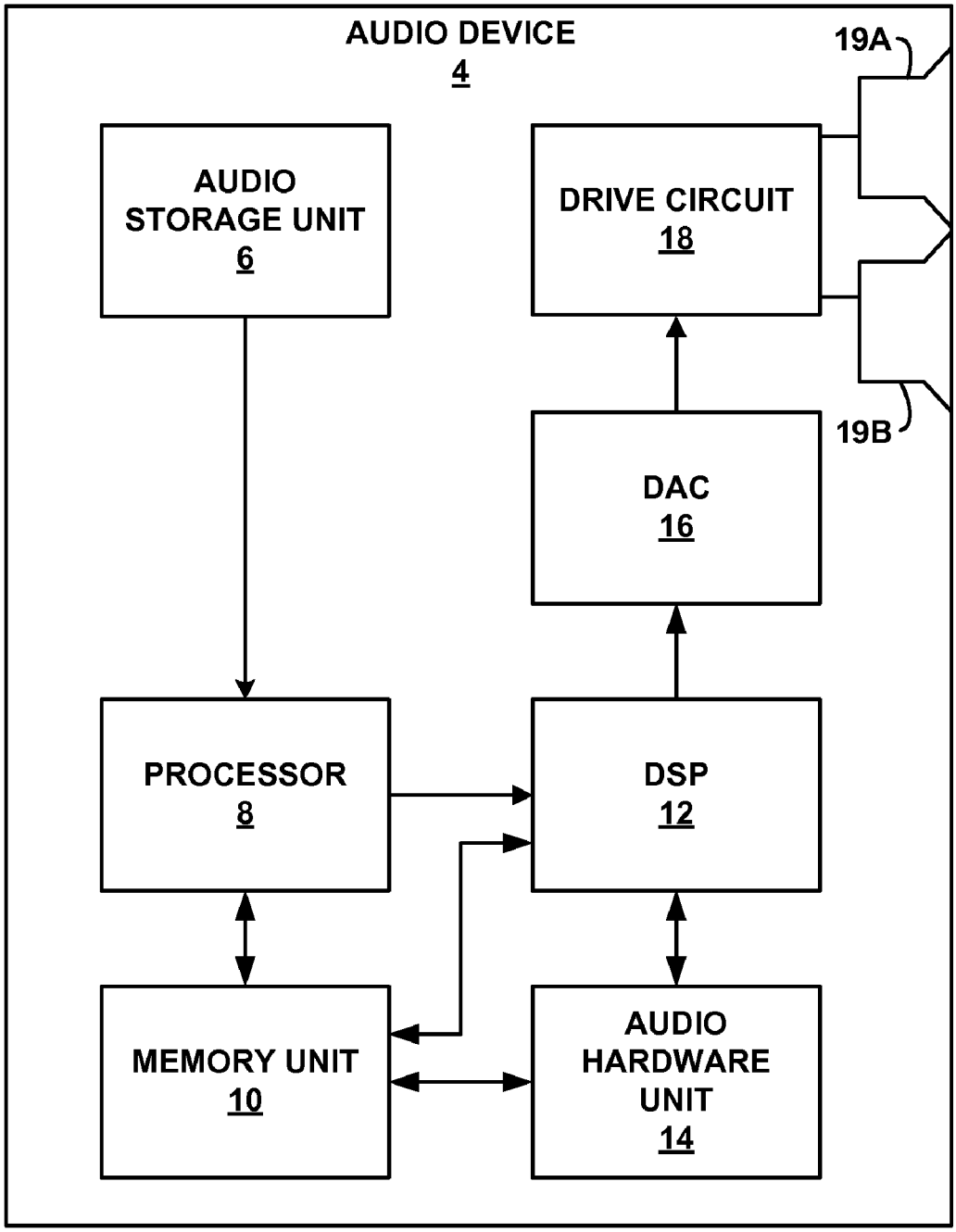
FIG. 1 is a block diagram illustrating an exemplary audio device that may implement techniques for processing audio files in accordance with this disclosure.

This disclosure describes techniques for processing audio files. The techniques may be particularly useful for playback of audio files that comply with the musical instrument digital interface (MIDI) format, although the techniques may be useful with other audio formats, techniques or standards that make use of synthesis parameters. As used herein, the term MIDI file refers to any audio data or file that contains at least one audio track that conforms to the MIDI format. Examples of various file formats that may include MIDI tracks include CMX, SMAF, XMF, SP-MIDI to name a few. CMX stands for Compact Media Extensions, developed by Qualcomm Inc. SMAF stands for the Synthetic Music Mobile Application Format, developed by Yamaha Corp. XMF stands for eXtensible Music Format, and SP-MIDI stands for Scalable Polyphony MIDI.

MIDI files, or other audio files can be conveyed between devices within audio frames, which may include audio information or audio-video (multimedia) information. An audio frame may comprise a single audio file, multiple audio files, or possibly one or more audio files and other information such as coded video frames. Any audio data within an audio frame may be termed an audio file, as used herein, including streaming audio data or one or more audio file formats listed above. According to this disclosure, techniques make use of a plurality of hardware elements that operate simultaneously to service various synthesis parameters generated from one or more audio files, such as MIDI files.

The described techniques may improve processing of audio files, such as MIDI files. The techniques may separate different tasks into software, firmware, and hardware. A general purpose processor may execute software to parse audio files of an audio frame and thereby identify timing parameters, and to schedule events associated with the audio files. The scheduled events can then be serviced by a DSP in a synchronized manner, as specified by timing parameters in the audio files. The general purpose processor dispatches the events to the DSP in a time-synchronized manner, and the DSP processes the events according to the time-synchronized schedule in order to generate synthesis parameters. The DSP then schedules processing of the synthesis parameters in a hardware unit, and the hardware unit can generate audio samples based on the synthesis parameters.

The synthesis parameters generated by the DSP can be stored in memory prior to processing by the hardware unit. According to this disclosure, the hardware unit includes a plurality of processing elements that operate simultaneously to service the different synthesis parameters. A first audio processing element, for example, processes a first audio synthesis parameter to generate first audio information. A second audio processing element processes a second audio synthesis parameter to generate second audio information. Audio samples can then be generated based at least in part on a combination of the first and second audio information. The different processing elements may each comprise an arithmetic logic unit that supports operations such as multiply, add and accumulate. In addition, each processing element may also support hardware specific operations for loading and/or storing to other hardware components such as a low frequency oscillator, a waveform fetch unit, and a summing buffer.

Alternatively, the tasks associated with MIDI file processing can be delegated between two different threads of a DSP and the dedicated hardware. That is to say, the tasks associated with the general purpose processor (as described herein) could alternatively be executed by a first thread of a multi-threaded DSP. In this case, the first thread of the DSP executes the scheduling, a second thread of the DSP generates the synthesis parameters, and the hardware unit generates audio samples based on the synthesis parameters. This alternative example may also be pipelined in a manner similar to the example that uses a general purpose processor for the scheduling.

FIG. 1 is a block diagram illustrating an exemplary audio device 4. As an example, audio device 4 may comprise any device capable of processing MIDI files, e.g., files that include at least one MIDI track. Again, however, the techniques of this disclosure may find application with other audio formats, techniques or standards. Examples of audio device 4 include a wireless communication device such as a radiotelephone, a network telephone, a digital music player, a music synthesizer, a wireless mobile device, a direct two-way communication device (sometimes called a walkie-talkie), a personal computer, a desktop or laptop computer, a workstation, a satellite radio device, an intercom device, a radio broadcasting device, a hand-held gaming device, an audio circuit board installed in a device, a kiosk device, a video game console, various computerized toys for children, an on-board computer used in an automobile, watercraft or aircraft, or a wide variety of other devices that process and output audio.

The various components illustrated in FIG. 1 are provided to explain aspects of this disclosure. However, other components may exist and some of the illustrated components may not be included in some implementations. For example, if audio device 4 is a radiotelephone, then an antenna, a transmitter, a receiver and a modem (modulator-demodulator) may be included to facilitate wireless communication of audio files.

As illustrated in the example of FIG. 1, audio device 4 includes an audio storage unit 6 to store audio files, such as MIDI files. Again, MIDI files generally refer to any audio file that includes at least one track coded in the MIDI format. Audio storage unit 6 may comprise any volatile or non-volatile memory or storage. For purposes of this disclosure, audio storage unit 6 can be viewed as a storage unit that forwards audio files to processor 8, or processor 8 retrieves MIDI files from audio storage unit 6, in order for the files to be processed. Audio storage unit 6 could also be a storage unit associated with a digital music player or a temporary storage unit associated with information transfer from another device. For example, audio storage unit 6 may buffer streaming audio obtained from a server or broadcast source. Audio storage unit 6 may be a separate volatile memory chip or non-volatile storage device coupled to processor 8 via a data bus or other connection. A memory or storage device controller (not shown) may be included to facilitate the transfer of information from audio storage unit 6.

Device 4 may implement an architecture that separates audio processing tasks between software, hardware and firmware. As shown in FIG. 1, device 4 includes a processor 8, a digital signal processor (DSP) 12 and a audio hardware unit 14. Each of these components may be coupled to a memory unit 10, e.g., directly or via a bus. Processor 8 may comprise a general purpose processor that executes software to parse audio files and schedule audio events associated with the audio files. The scheduled events can be dispatched to DSP 12 in a time-synchronized manner and thereby serviced by DSP 12 in a synchronized manner, as specified by timing parameters in the audio files. DSP 12 may comprise firmware that processes the audio events according to the time-synchronized schedule created by general purpose processor 8 in order to generate synthesis parameters. DSP 12 may also schedule subsequent processing of the synthesis parameters by audio hardware unit 14.

Once DSP 12 has generated the synthesis parameters, these synthesis parameters can be stored in memory unit 10. Memory unit 10 may comprise volatile or non-volatile storage. In order to support quick data transfer, memory unit 10 may comprise random access memory (RAM), dynamic random access memory (DRAM), synchronous dynamic random access memory (SDRAM), FLASH memory, or the like. In any case, the synthesis parameters stored in memory unit 10 can be serviced by audio hardware unit 14 to generate audio samples.

In accordance with this disclosure, audio hardware unit 14 generates audio samples based on the synthesis parameters. To do so, audio hardware unit 14 may include a number of hardware components that can help to process the synthesis parameters in a fast and efficient manner. For example, according to this disclosure, audio hardware unit 14 includes a plurality of audio processing elements that operate simultaneously to service the different synthesis parameters. A first audio processing element, for example, processes a first audio synthesis parameter to generate first audio information while a second audio processing element processes a second audio synthesis parameter to generate second audio information. Audio samples can then be generated by hardware unit 14 based at least in part on a combination of the first and second audio information generated by the different audio processing elements in hardware unit.

The different processing elements in audio hardware unit 14 may each comprise an arithmetic logic unit (ALU) that supports operations such as multiply, add and accumulate. In addition, each processing element may also support hardware specific operations for loading and/or storing to other hardware components. The other hardware components in audio hardware unit, for example, may comprise an low frequency oscillator (LFO), a waveform fetch unit (WFU), and a summing buffer (SB). Thus, the processing elements in audio hardware unit 14 may support and execute instructions for interacting and using these other hardware components in the audio processing. Additional details of one example of audio hardware unit 14 are provided in greater detail below with reference to FIG. 2.

In some cases, the processing of audio files by device 4 may be pipelined. For example, processor 8, DSP 12 and audio hardware unit 14 may operate simultaneously with respect to successive audio frames. Each of the audio frames may correspond to a block of time, e.g., a 10 millisecond (ms) interval, that includes many coded audio samples. Digital output of hardware unit 14, for example, many include 480 digital audio samples per audio frame, which can be converted into an analog audio signal by digital-to-analog converter 16. Many events may correspond to one instance of time so that many different sounds or notes can be included in one instance of time according to the MIDI format or similar audio format. Of course, the amount of time delegated to any audio frame and the number of audio samples defined in one frame may vary in different implementations.

In some cases, audio samples generated by audio hardware unit 14 are delivered back to DSP 12, e.g., via interrupt-driven techniques. In this case, DSP may also perform post processing techniques on the audio samples. The post processing may include filtering, scaling, volume adjustment, or a wide variety of audio post processing that may ultimately enhance the sound output. Digital-to-analog converter (DAC) 16 then converts the audio samples into analog signals, which can be used by drive circuit 18 to drive speakers 19A and 19B for output of audio sounds to a user.

Memory 10 may be structured such that processor 8, DSP 12 and MIDI hardware 14 can access any information needed to perform the various tasks delegated to these different components. In some cases, the storage layout of MIDI information in memory 10 may be arranged to allow for efficient access from the different components 8, 12 and 14. Again, memory 10 is used to store (among other things) the synthesis parameters associated with one or more audio files. Once DSP 12 generates these synthesis parameters, they can be processed by hardware unit 14, as explained herein, to generate audio samples. The audio samples generated by audio hardware unit 18 may comprise pulse-code modulation (PCM) samples, which are digital representations of an analog signal wherein the analog signal is sampled at regular intervals. Additional details of exemplary audio generation by audio hardware unit 14 are discussed in greater detail below with reference to FIG. 2.

Figure 2:
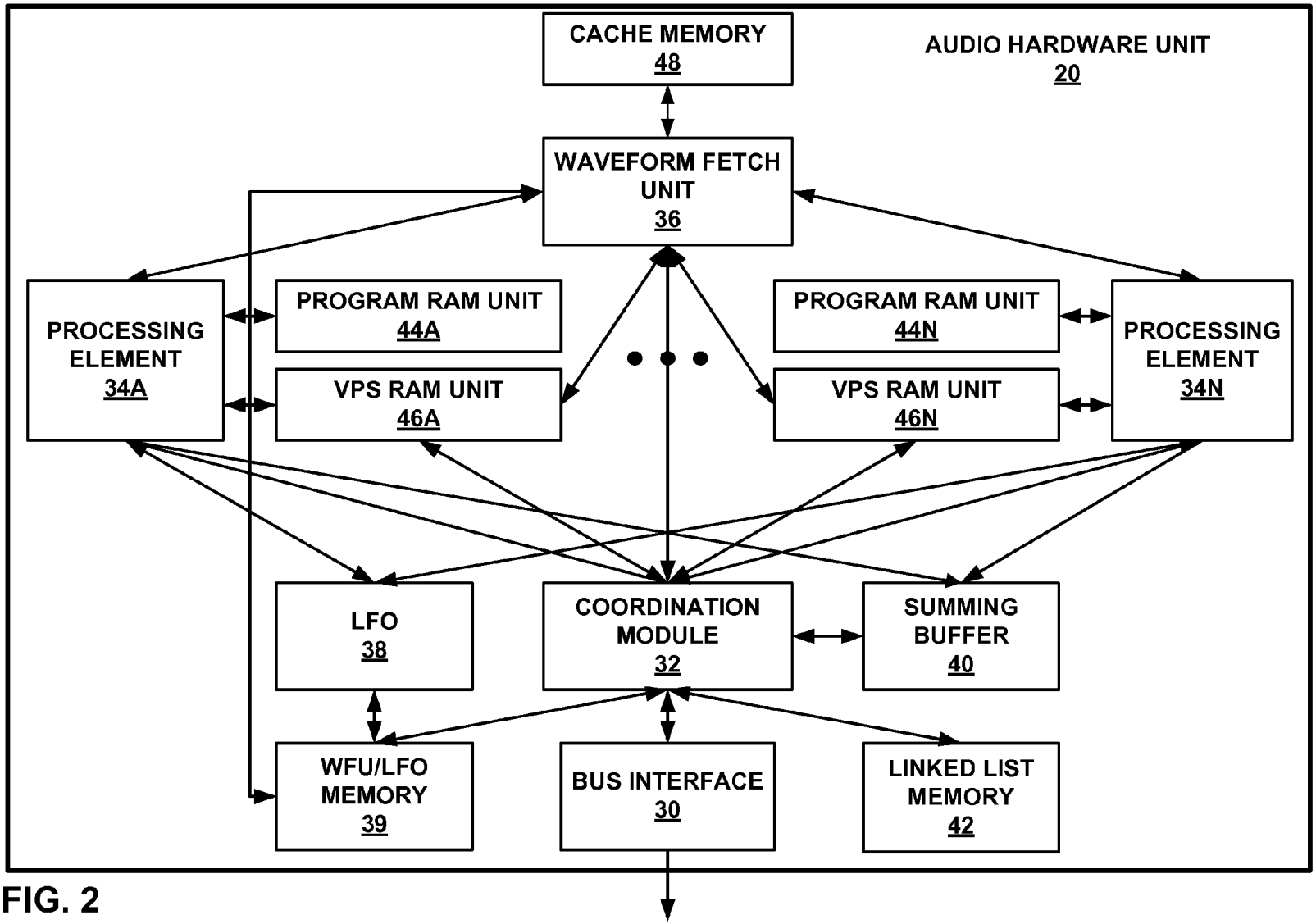
FIG. 2 is a block diagram of one example of a hardware unit for processing synthesis parameters according to this disclosure.

FIG. 2 is a block diagram illustrating an exemplary audio hardware unit 20, which may correspond to audio hardware unit 14 of audio device 4. The implementation shown in FIG. 2 is merely exemplary as other hardware implementations could also be defined consistent with the teaching of this disclosure. As illustrated in the example of FIG. 2, audio hardware unit 20 includes a bus interface 30 to send and receive data. For example, bus interface 30 may include an AMBA High-performance Bus (AHB) master interface, an AHB slave interface, and a memory bus interface. AMBA stands for advanced microprocessor bus architecture. Alternatively, bus interface 30 may include an AXI bus interface, or another type of bus interface. AXI stands for advanced extensible interface.

In addition, audio hardware unit 20 may include a coordination module 32. Coordination module 32 coordinates data flows within audio hardware unit 20. When audio hardware unit 20 receives an instruction from DSP 12 (FIG. 1) to begin synthesizing an audio sample, coordination module 32 reads the synthesis parameters for the audio frame from memory 10, which were generated by DSP 12 (FIG. 1). These synthesis parameters can be used to reconstruct the audio frame. For the MIDI format, synthesis parameters describe various sonic characteristics of one or more MIDI voices within a given frame. For example, a set of MIDI synthesis parameters may specify a level of resonance, reverberation, volume, and/or other characteristics that can affect one or more voices.

At the direction of coordination module 32, synthesis parameters may be loaded from memory 10 (FIG. 1) into voice parameter set (VPS) RAM 46A or 46N associated with a respective processing element 34A or 34N. At the direction of DSP 12 (FIG. 1), program instructions are loaded from memory 10 into program RAM units 44A or 44N associated with a respective processing element 34A or 34N.

The instructions loaded into program RAM unit 44A or 44N instruct the associated processing element 34A or 34N to synthesize one of the voices indicated in the list of synthesis parameters in VPS RAM unit 46A or 46N. There may be any number of processing elements 34A-34N (collectively "processing elements 34"), and each may comprise one or more ALUs that are capable of performing mathematical operations, as well as one or more units for reading and writing data. Only two processing elements 34A and 34N are illustrated for simplicity, but many more may be included in hardware unit 20. Processing elements 34 may synthesize voices in parallel with one another. In particular, the plurality of different processing elements 34 work in parallel to process different synthesis parameters. In this manner, a plurality of processing elements 34 within audio hardware unit 20 can accelerate and possibly improve the generation of audio samples.

When coordination module 32 instructs one of processing elements 34 to synthesize a voice, the respective processing element may execute one or more instructions associated with the synthesis parameters. Again, these instructions may be loaded into program RAM unit 44A or 44N. The instructions loaded into program RAM unit 44A or 44N cause the respective one of processing elements 34 to perform voice synthesis. For example, processing elements 34 may send requests to a waveform fetch unit (WFU) 36 for a waveform specified in the synthesis parameters. Each of processing elements 34 may use WFU 36. An arbitration scheme may be used to resolve any conflicts if two or more processing elements 34 request use of WFU 36 at the same time.

In response to a request from one of processing elements 34, WFU 36 returns one or more waveform samples to the requesting processing element. However, because a wave can be phase shifted within a sample, e.g., by up to one cycle of the wave, WFU 36 may return two samples in order to compensate for the phase shifting using interpolation. Furthermore, because a stereo signal may include two separate waves for the two stereophonic channels, WFU 36 may return separate samples for different channels, e.g., resulting in up to four separate samples for stereo output.

After WFU 36 returns audio samples to one of processing elements 34, the respective processing element may execute additional program instructions based on the synthesis parameters. In particular, instructions cause one of processing elements 34 to request an asymmetric triangular wave from a low frequency oscillator (LFO) 38 in audio hardware unit 20. By multiplying a waveform returned by WFU 36 with a triangular wave returned by LFO 38, the respective processing element may manipulate various sonic characteristics of the waveform to achieve a desired audio affect. For example, multiplying a waveform by a triangular wave may result in a waveform that sounds more like a desired musical instrument.

Other instructions executed based on the synthesis parameters may cause a respective one of processing elements 34 to loop the waveform a specific number of times, adjust the amplitude of the waveform, add reverberation, add a vibrato effect, or cause other effects. In this way, processing elements 34 can calculate a waveform for a voice that lasts one MIDI frame. Eventually, a respective processing element may encounter an exit instruction. When one of processing elements 34 encounters an exit instruction, that processing element signals the end of voice synthesis to coordination module 32. The calculated voice waveform can be provided to summing buffer 40 at the direction of another store instruction during the execution of the program instructions, and causes summing buffer 40 to store that calculated voice waveform.

When summing buffer 40 receives a calculated waveform from one of processing elements 34, summing buffer 40 adds the calculated waveform to the proper instance of time associated with an overall waveform for a MIDI frame. Thus, summing buffer 40 combines output of the plurality of processing elements 34. For example, summing buffer 40 may initially store a flat wave (i.e., a wave where all digital samples are zero.) When summing buffer 40 receives audio information such as a calculated waveform from one of processing elements 34, summing buffer 40 can add each digital sample of the calculated waveform to respective samples of the waveform stored in summing buffer 40. In this way, summing buffer 40 accumulates and stores an overall digital representation of a waveform for a full audio frame.

Summing buffer 40 essentially sums different audio information from different ones of processing elements 34. The different audio information is indicative of different instances of time associated with different generated voices. In this manner, summing buffer 40 creates audio samples representative of an overall audio compilation within a given audio frame.

Processing elements 34 may operate in parallel with one another, yet independently. That is to say, each of processing elements 34 may process a synthesis parameter, and then move on to the next synthesis parameter once the audio information generated for the first synthesis parameter is added to summing buffer 40. Thus, each of processing elements 34 performs its processing tasks for one synthesis parameter independently of the other processing elements 34, and when the processing for synthesis parameter is complete that respective processing element becomes immediately available for subsequent processing of another synthesis parameter.

Eventually, coordination module 32 may determine that processing elements 34 have completed synthesizing all of the voices required for the current audio frame and have provided those voices to summing buffer 40. At this point, summing buffer 40 contains digital samples indicative of a completed waveform for the current audio frame. When coordination module 32 makes this determination, coordination module 32 sends an interrupt to DSP 12 (FIG. 1). In response to the interrupt, DSP 12 may send a request to a control unit in summing buffer 40 (not shown) via direct memory exchange (DME) to receive the content of summing buffer 40. Alternatively, DSP 12 may also be pre-programmed to perform the DME. DSP 12 may then perform any post processing on the digital audio samples, before providing the digital audio samples to DAC 16 for conversion into the analog domain. In some cases, the processing performed by audio hardware unit 20 with respect to a frame N+2 occurs simultaneously with synthesis parameter generation by DSP 12 (FIG. 1) respect to a frame N+1, and scheduling operations by processor 8 (FIG. 1) respect to a frame N.

Cache memory 48, WFU/LFO memory 39 and linked list memory 42 are also shown in FIG. 2. Cache memory 48 may be used by WFU 36 to fetch base waveforms in a quick and efficient manner. WFU/LFO memory 39 may be used by coordination module 32 to store voice parameters of the voice parameter set. In this way, WFU/LFO memory 39 can be viewed as memories dedicated to the operation of waveform fetch unit 36 and LFO 38. Linked list memory 42 may comprise a memory used to store a list of voice indicators generated by DSP 12. The voice indicators may comprise pointers to one or more synthesis parameters stored in memory 10. Each voice indicator in the list may specify the memory location that stores a voice parameter set for a respective MIDI voice. The various memories and arrangements of memories shown in FIG. 2 are purely exemplary. The techniques described herein could be implemented with a variety of other memory arrangements.

In accordance with this disclosure, any number of processing elements 34 may be included in audio hardware unit 20 provided that a plurality of processing elements 34 operate simultaneously with respect to different synthesis parameters stored in memory 10 (FIG. 1). A first audio processing element 34A, for example, processes a first audio synthesis parameter to generate first audio information while another audio processing element 34N processes a second audio synthesis parameter to generate second audio information. Summing buffer 40 can then combine the first and second audio information in the creation of one or more audio samples. Similarly, a third audio processing element (not shown) and a fourth processing element (not shown) may process third and forth synthesis parameters to generate third and fourth audio information, which can also be accumulated in summing buffer 40 in the creation of the audio samples.

Processing elements 34 may process all of the synthesis parameters for an audio frame. After processing each respective synthesis parameter, the respective one of processing elements 34 adds its processed audio information in to the accumulation in summing buffer 40, and then moves on to the next synthesis parameter. In this way, processing elements 34 work collectively to process all of the synthesis parameters generated for one or more audio files of an audio frame. Then, after the audio frame is processed and the samples in summing buffer are sent to DSP 12 for post processing, processing elements 34 can begin processing the synthesis parameters for the audio files of the next audio frame.

Again, first audio processing element 34A processes a first audio synthesis parameter to generate first audio information while a second audio processing element 34N processes a second audio synthesis parameter to generate second audio information. At this point, first processing element 34A may process a third audio synthesis parameter to generate third audio information while a second audio processing element 34N processes a fourth audio synthesis parameter to generate fourth audio information. Summing buffer 40 can combine the first, second, third and fourth audio information in the creation of one or more audio samples.

Figure 3:
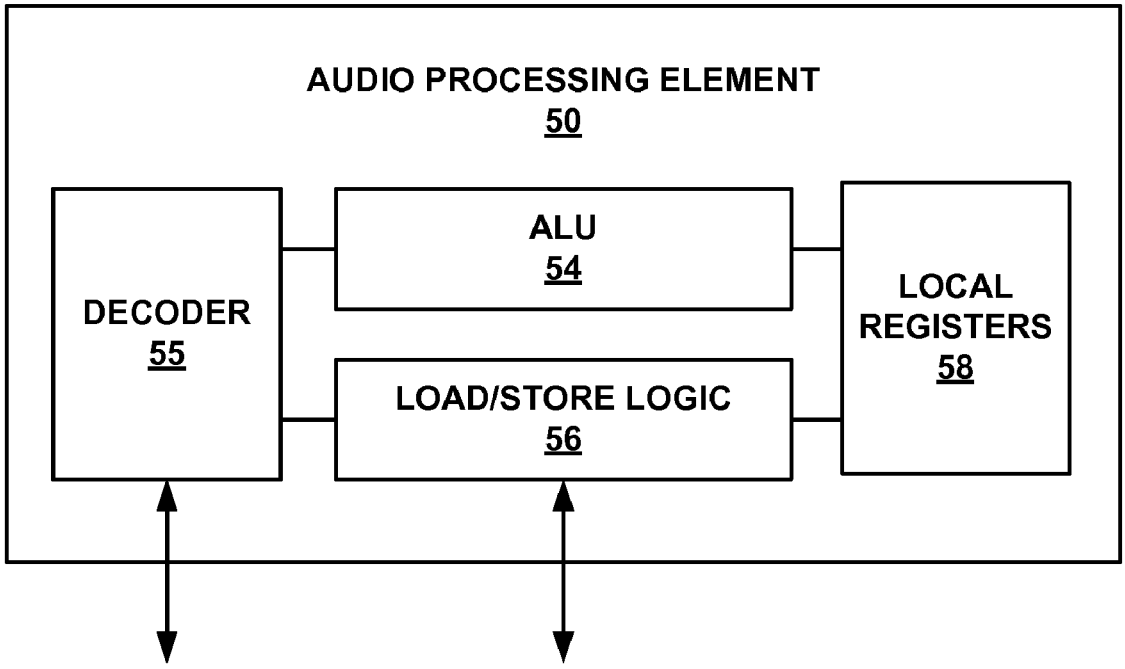
FIG. 3 is a block diagram of one example of an audio processing element according to this disclosure.

FIG. 3 is a block diagram of one example of an audio processing element 50 according to this disclosure. Audio processing element 50 may correspond to each of audio processing elements 34 in FIG. 2. As shown in FIG. 3, audio processing element 50 may include, a decoder 55, an arithmetic logic unit (ALU) 54, load/store logic 56, and local registers 58. In this manner, audio processing element 50 is designed to efficiently process synthesis parameters by using simple arithmetic logic operations and load and/or store operations for accessing the logic of other components in hardware unit 20.

Decoder 55 is coupled to a respective one of program RAM units 44A or 44B (shown in FIG. 2). Program RAM units 44 store one or more instructions associated with the execution of a synthesis parameter being serviced by audio processing unit 50. These instructions decoded by decoder 55 and then executed using ALU 54 and load/store logic 56. In this manner, audio processing element 50 uses ALU 54 and load/store logic 56 to process the synthesis parameters.

ALU 54 may support one or more multiply operations, one or more add operations, and one or more accumulate operations. ALU 54 can execute these operations in the processing of synthesis parameters. These basic operations may form a fundamental set of logic operations typically needed to service synthesis parameters. These basic operations, however, may also provide flexibility to processing element 50 such that it can be used for other purposes unrelated to synthesis parameter processing.

Load/store logic 56 support one or more loading operations and one or more storing operations associated with a specific audio format. Load/store logic 56 can execute these load and store operations in the processing of synthesis parameters. In this manner, load/store logic 56 facilitates the use of other hardware for that specific audio format via loading and storing operations to such logic. As an example, for the MIDI format, load/store logic 56 may support separate operations for a low frequency oscillator such as LFO 38 (FIG. 2), a waveform fetch unit such as unit 36 (FIG. 2), and a summing buffer such as summing buffer 40 (FIG. 2). Operations to support loads from LFO 38 and waveform fetch unit 36 can allow audio processing element 50 to load necessary waveforms from these units, while operations to support stores to summing buffer 40 can allow audio processing element 50 to forward its generated audio information associated with each processed synthesis parameter. Load/store logic 56 may also support load operations to load data from a VPS RAM unit 46A or 46N into the respective processing element.

Figure 4:
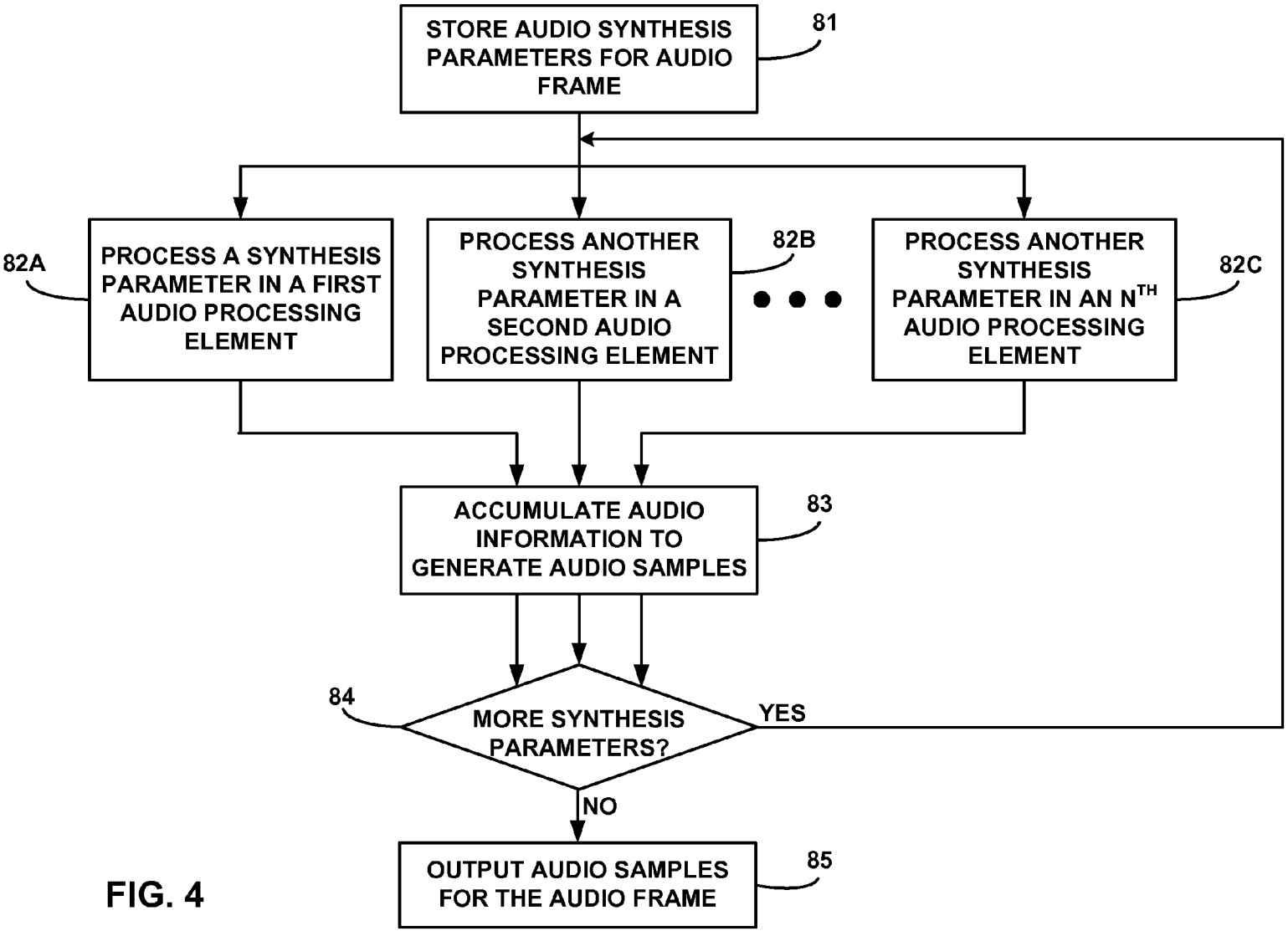
FIGS. 4-5 are flow diagrams illustrating exemplary techniques processing audio files consistent with this disclosure.

FIG. 4 is a flow diagram illustrating an exemplary technique consistent with the teaching of this disclosure. FIG. 4 will be described with reference to device 4 of FIG. 1 and hardware unit 20 of FIG. 2. However, other devices could implement the techniques of FIG. 4. As shown in FIG. 4, memory 10 stores audio synthesis parameters for an audio frame (81). The audio synthesis parameters, for example, may be generated by DSP 12 in processing the scheduled events specified in one or more audio files of the audio frame.

A plurality of different processing elements 34 then simultaneously process different synthesis parameters (82A, 82B and 82C). In particular, a first synthesis parameter is processed in a first processing element 34A (82A), a second synthesis parameter is processed in a second processing element (not shown in FIG. 2) (82B), and an $N^{th}$ synthesis parameter is processed in an $N^{th}$ processing element 34N (82C). Synthesis parameters may include parameters that define pitch, resonance, reverberation, volume, and/or other characteristics that can affect one or more voices.

Any number of processing elements 34 may be used. Any time that one of processing elements 34 finishes the respective processing and encounters exit and store instructions, the generated audio information associated with that processing element is accumulated in summing buffer 40 (83). In this manner, accumulation is used to generate audio samples in summing buffer 40. If more synthesis parameters exist for the audio frame (yes branch of 84), the respective processing element 34 then processes the next synthesis parameter (82A, 82B or 82C). This process continues until all of the synthesis parameters for the audio frame are serviced (no branch of 84). At this point, summing buffer 40 outputs the audio samples for the audio frame (85). For example, coordination module 32 may send an interrupt command to DSP 12 (FIG. 1) to cause the audio samples to be sent to DSP 12 for post processing.

Figure 5:
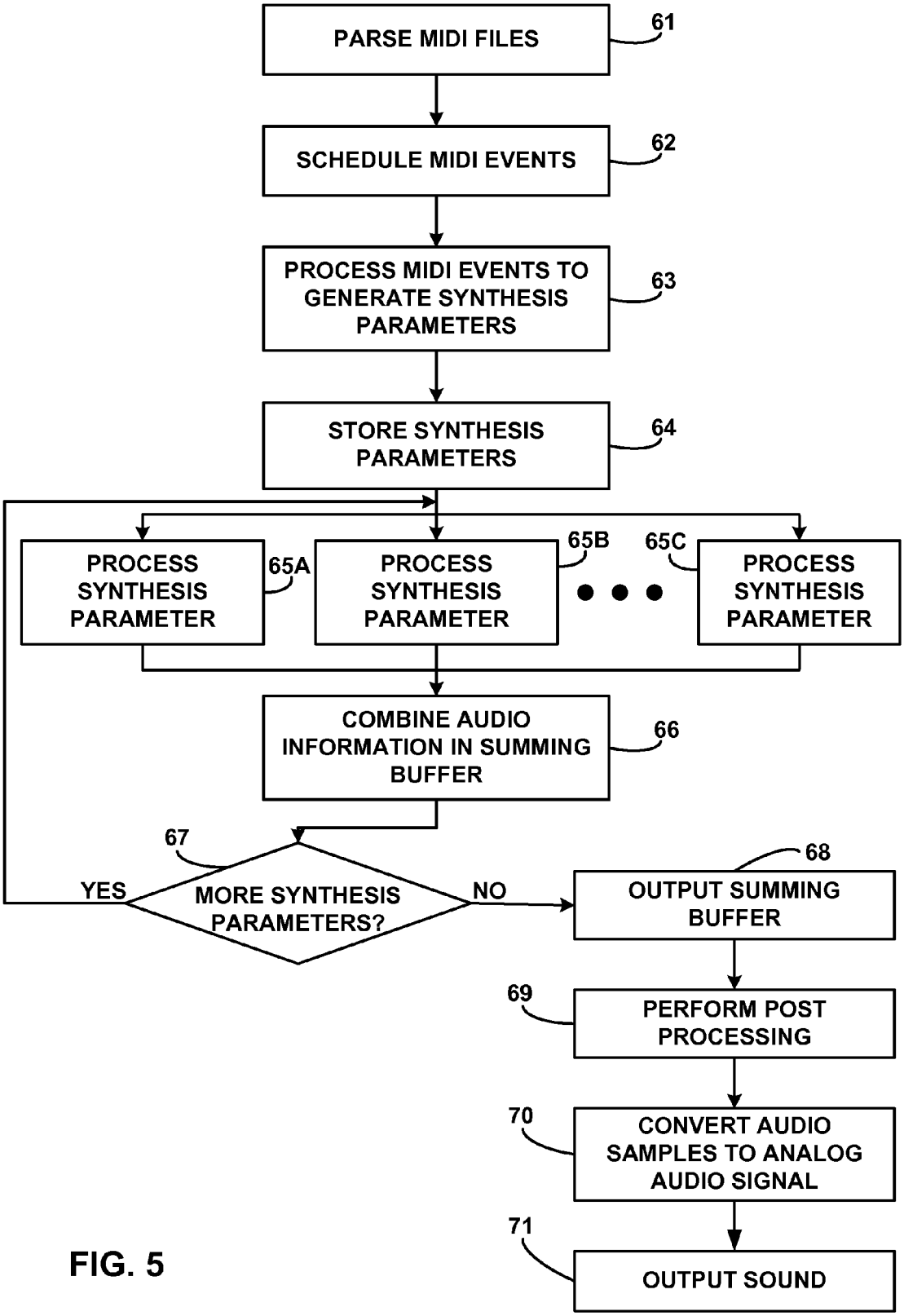

FIG. 5 is another flow diagram illustrating an exemplary technique consistent with the teaching of this disclosure. FIG. 5 will also be described with reference to device 4 of FIG. 1 and hardware unit 20 of FIG. 2 although other devices could implement the techniques of FIG. 5. As shown in FIG. 5, processor 8 parses MIDI files of an audio frame (61) and scheduled MIDI events (62) for servicing by DSP 12. Processor 8, for example, may parse the MIDI files by examining the MIDI files to identify timing parameters indicative of MIDI events that need scheduling. Processor 8 may dispatch the events to DSP 12 in a time-synchronized manner, or possibly generate a schedule for the processing of events by DSP 12.

DSP 12 then processes the MIDI events according to the timing defined by processor 8 to generate synthesis parameters (63). The synthesis parameters generated by DSP 12 can be stored in memory (64). At this point, processing elements 34 simultaneously process different synthesis parameters (65A, 65B and 65C). Any time that one of processing elements 34 finishes the respective processing, the generated audio information associated with that processing element is combined with an accumulation in summing buffer 40 (66) to generate audio samples. If more synthesis parameters exist for the audio frame (yes branch of 67), the respective processing element 34 then processes the next synthesis parameter (65A, 65B or 65C). This process continues until all of the synthesis parameters for the audio frame are processed (no branch of 67). At this point, summing buffer 40 outputs the audio samples for the audio frame (68). For example, coordination module 32 may send an interrupt command to DSP 12 (FIG. 1) to cause the audio samples to be sent to DSP 12.

DSP 12 performs post processing on the audio samples (69). The post processing may include filtering, scaling, volume adjustment, or a wide variety of audio post processing that may ultimately enhance the sound output. Following the post processing, DSP 12 may output the post processed audio samples to DAC 16, which converts the digital audio samples into an analog signal (70). The output of DAC 16 may be provided to drive circuit 18, which amplifies the signal to drive one or more speakers 19A and 19B to create audible sound that is output to the user (71).

In some cases, the processing by processor 8, DSP 12 and processing elements 34 of hardware unit 20 may be pipelined. That is to say, when processing elements 34 are processing the synthesis parameters for frame N+2, DSP 12 may be generating synthesis parameters for frame N+1 and processor 8 may be scheduling events for frame N. Although not shown in FIG. 5, the process may continue such that after outputting the audio samples from summing buffer 40 (68), the synthesis parameters for the next audio frame are then processed by processing elements 34.

Various examples have been described. One or more aspects of the techniques described herein may be implemented in hardware, software, firmware, or combinations thereof. Any features described as modules or components may be implemented together in an integrated logic device or separately as discrete but interoperable logic devices. If implemented in software, one or more aspects of the techniques may be realized at least in part by a computer-readable medium comprising instructions that, when executed, performs one or more of the methods described above. The computer-readable data storage medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates code in the form of instructions or data structures and that can be accessed, read, and/or executed by a computer.

The instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated software modules or hardware modules configured or adapted to perform the techniques of this disclosure.

If implemented in hardware, one or more aspects of this disclosure may be directed to a circuit, such as an integrated circuit, chipset, ASIC, FPGA, logic, or various combinations thereof configured or adapted to perform one or more of the techniques described herein. The circuit may include both the processor and one or more hardware units, as described herein, in an integrated circuit or chipset.

It should also be noted that a person having ordinary skill in the art will recognize that a circuit may implement some or all of the functions described above. There may be one circuit that implements all the functions, or there may also be multiple sections of a circuit that implement the functions. With current mobile platform technologies, an integrated circuit may comprise at least one DSP, and at least one Advanced Reduced Instruction Set Computer (RISC) Machine (ARM) processor to control and/or communicate to DSP or DSPs. Furthermore, a circuit may be designed or implemented in several sections, and in some cases, sections may be re-used to perform the different functions described in this disclosure.

Various aspects and examples have been described. However, modifications can be made to the structure or techniques of this disclosure without departing from the scope of the following claims. For example, other types of devices could also implement the processing techniques described herein. Also, although the exemplary hardware unit 20 shown in FIG. 2 uses a wave-table based approach to voice synthesis, other approaches including frequency modulation synthesis approaches could also be used. In addition, although detailed examples of the processing of MIDI files have been described, the techniques and structure of this disclosure may also apply to files coded according to other audio formats. These and other examples are within the scope of the following claims.

The invention claimed is:

1. A method comprising:

parsing one or more audio files of an audio frame and scheduling events associated with the one or more audio files for execution in a digital signal processor;

dispatching the events to the digital signal processor in a time-synchronized manner based on timing parameters in the one or more audio files;

processing the events via the digital signal processor to generate audio synthesis parameters;

storing the audio synthesis parameters generated for the one or more audio files of the audio frame in a memory;

processing a first audio synthesis parameter using a first audio processing element of a hardware unit to generate first audio information;

processing a second audio synthesis parameter using a second audio processing element of the hardware unit to generate second audio information, wherein the first and second audio processing elements operate in parallel to service different ones of the audio synthesis parameters stored in the memory; and generating audio samples for the audio frame based at least in part on a combination of the first and second audio information.

2. The method of claim 1, further comprising:

processing a third audio synthesis parameter using a third audio processing element of the hardware unit to generate third audio information; and generating the audio samples based at least in part on a combination of the first, second and third audio information.

3. The method of claim 1, wherein the one or more audio files comprise musical instrument digital interface (MIDI) files, and wherein the audio synthesis parameters comprise MIDI synthesis parameters generated based on events in the MIDI files.

4. The method of claim 1, further comprising combining the first and second audio information by accumulating the first and second audio information in a summing buffer.

5. The method of claim 1, wherein the first and second audio processing elements comprise an arithmetic logic unit that supports one or more multiply operations, one or more add operations, and one or more accumulate operations, wherein processing the first and second synthesis parameters comprises performing one or more multiply operations, one or more add operations, or one or more accumulate operations.

6. The method of claim 5, wherein the first and second audio processing elements also support one or more loading operations and one or more storing operations associated with a specific audio format, wherein processing the first and second synthesis parameters comprises performing one or more loading operations, or one or more storing operations associated with the specific audio format.

7. The method of claim 6, wherein the loading and storing operations include separate operations for a low frequency oscillator, a waveform fetch unit and a summing buffer.

8. The method of claim 6, wherein the specific audio format comprises musical instrument digital interface (MIDI).

9. The method of claim 1, wherein the first and second audio processing elements each include local registers.

10. The method of claim 1, further comprising:

processing a third audio synthesis parameter using the first audio processing element of the hardware unit to generate third audio information;

processing a fourth audio synthesis parameter using the second audio processing element of the hardware unit to generate fourth audio information; and generating the audio samples for the audio frame based at least in part on a combination of the first, second, third and fourth audio information.

11. A device comprising:

a digital signal processor that receives events dispatched to the digital signal processor in a time-synchronized manner based on timing parameters in one or more audio files of an audio frame, wherein the digital signal processor processes the events to generate audio synthesis parameters;

a memory that stores the audio synthesis parameters generated by the digital signal processor for the one or more audio flies of the audio frame; and a hardware unit that generates audio samples for the audio frame based on the audio synthesis parameters generated by the digital signal processor, the hardware unit including:

a first audio processing element that generates first audio information based on a first audio synthesis parameter; and a second audio processing element that generates second audio information based on a second audio synthesis parameter, wherein the first and second audio processing elements operate in parallel to service different ones of the audio synthesis parameters stored in the memory, and wherein the hardware unit generates the audio samples based at least in part on a combination of the first and second audio information.

12. The device of claim 11, further comprising:

a third audio processing element that generates third audio information based on a third audio synthesis parameter, wherein the hardware unit generates the audio samples based at least in part on a combination of the first, second and third audio information.

13. The device of claim 11, wherein the one or more audio files comprise musical instrument digital interface (MIDI) files, and wherein the audio synthesis parameters comprise MIDI synthesis parameters generated based on events in the MIDI files.

14. The device of claim 11, further comprising a summing buffer that combines the first and second audio information by accumulating the first and second audio information.

15. The device of claim 11, wherein the first and second audio processing elements each comprise an arithmetic logic unit that executes one or more multiply operations, one or more add operations, and one or more accumulate operations.

16. The device of claim 15, wherein the first and second audio processing elements also execute one or more loading operations and one or more storing operations associated with a specific audio format.

17. The device of claim 16, the hardware unit further comprising a low frequency oscillator, a waveform fetch unit and a summing buffer, wherein the loading and storing operations include separate operations for interacting with the low frequency oscillator, the waveform fetch unit and the summing buffer.

18. The device of claim 16, wherein the specific audio format comprises musical instrument digital interface (MIDI).

19. The device of claim 11, wherein the first and second audio processing elements each include local registers.

20. The device of claim 11, further wherein:

the first audio processing element generates third audio information based on a third audio synthesis parameter;

the second audio processing element generates fourth audio information based on a fourth audio synthesis parameter; and the hardware unit generates the audio samples based at least in part on a combination of the first, second, third and fourth audio information.

21. A device comprising:

means for parsing one or more audio files of an audio frame and scheduling events associated with the one or more audio files for execution in a digital signal processor;

means for dispatching the events to the digital signal processor in a time-synchronized manner based on timing parameters in the one or more audio files;

means for processing the events via the digital signal processor to generate audio synthesis parameters;

means for storing the audio synthesis parameters generated for the one or more audio files of the audio frame in a memory;

means for processing a first audio synthesis parameter using a first audio processing element of a hardware unit to generate first audio information;

means for processing a second audio synthesis parameter using a second audio processing element of the hardware unit to generate second audio information, wherein the first and second audio processing elements operate in parallel to service different ones of the audio synthesis parameters stored in the memory; and means for generating audio samples for the audio frame based at least in part on a combination of the first and second audio information.

22. The device of claim 21, further comprising:

means for processing a third audio synthesis parameter to generate third audio information, wherein the means for generating generates the audio samples based at least in part on a combination of the first, second and third audio information.

23. The device of claim 21, wherein the one or more audio files comprise musical instrument digital interface (MIDI) files, and wherein the audio synthesis parameters comprise MIDI synthesis parameters generated based on events in the MIDI files.

24. The device of claim 21, further comprising means for combining the first and second audio information by accumulating the first and second audio information.

25. The device of claim 21, wherein the first and second means for processing include an arithmetic logic unit that supports one or more multiply operations, one or more add operations, and one or more accumulate operations.

26. The device of claim 25, wherein the first and second means for processing also support one or more loading operations and one or more storing operations associated with a specific audio format.

27. The device of claim 26, wherein the loading and storing operations include separate operations for a low frequency oscillator, a waveform fetch unit and a summing buffer.

28. The device of claim 26, wherein the specific audio format comprises musical instrument digital interface (MIDI).

29. The device of claim 21, wherein the first and second means for processing each include memory.

30. The device of claim 21, further wherein:

the means for processing the first audio synthesis parameter also process a third audio synthesis parameter to generate third audio information;

the means for processing the second audio synthesis parameter also process a fourth audio synthesis parameter to generate fourth audio information; and the means for generating generates the audio samples for the audio frame based at least in part on a combination of the first, second, third and fourth audio information.

31. A computer-readable medium comprising instructions that upon execution cause one or more processors to:

parse one or more audio files of an audio frame and scheduling events associated with the one or more audio files for execution in a digital signal processor;

dispatch the events to the digital signal processor in a time-synchronized manner based on timing parameters in the one or more audio files;

process the events via the digital signal processor to generate audio synthesis parameters;

store the audio synthesis parameters generated for the one or more audio files of the audio frame in a memory;

process a first audio synthesis parameter using a first audio processing element of a hardware unit to generate first audio information;

process a second audio synthesis parameter using a second audio processing element of the hardware unit to generate second audio information, wherein the first and second audio processing elements operate in parallel to service different ones of the audio synthesis parameters stored in the memory; and generate audio samples for the audio frame based at least in part on a combination of the first and second audio information.

32. The computer-readable medium of claim 31, further comprising instructions that upon execution, cause one or more processors to:

process a third audio synthesis parameter using a third audio processing element of the hardware unit to generate third audio information; and generate the audio samples based at least in part on a combination of the first, second and third audio information.

33. The computer-readable medium of claim 31, wherein the one or more audio files comprise musical instrument digital interface (MIDI) files, and wherein the audio synthesis parameters comprise MIDI synthesis parameters generated based on events in the MIDI files.

34. The computer-readable medium of claim 31, further comprising instructions that upon execution cause one or more processors to combine the first and second audio information by accumulating the first and second audio information in a summing buffer.

35. The computer-readable medium of claim 31, wherein the first and second audio processing elements comprise an arithmetic logic unit that supports one or more multiply operations, one or more add operations, and one or more accumulate operations, wherein processing the first and second synthesis parameters comprises performing one or more multiply operations, one or more add operations, or one or more accumulate operations.

36. The computer-readable medium of claim 35, wherein the first and second audio processing elements also support one or more loading operations and one or more storing operations associated with a specific audio format, wherein processing the first and second synthesis parameters comprises performing one or more loading operations, or one or more storing operations associated with the specific audio format.

37. The computer-readable medium of claim 36, wherein the loading and storing operations include separate operations for a low frequency oscillator, a waveform fetch unit and a summing buffer.

38. The computer-readable medium of claim 36, wherein the specific audio format comprises musical instrument digital interface (MIDI).

39. The computer-readable medium of claim 31, wherein the first and second audio processing elements each include local registers.

40. The computer-readable medium of claim 31, further comprising instructions that upon execution cause one or more processors to:

process a third audio synthesis parameter using the first audio processing element of the hardware unit to generate third audio information;

process a fourth audio synthesis parameter using the second audio processing element of the hardware unit to generate fourth audio information; and generate the audio samples for the audio frame based at least in part on a combination of the first, second, third and fourth audio information.

41. A circuit configured to:

parse one or more audio files of an audio frame and scheduling events associated with the one or more audio files for execution in a digital signal processor;

dispatch the events to the digital signal processor in a time-synchronized manner based on timing parameters in the one or more audio files;

process the events via the digital signal processor to generate audio synthesis parameters;

store the audio synthesis parameters generated for the one or more audio files of the audio frame in a memory;

process a first audio synthesis parameter using a first audio processing element of a hardware unit to generate first audio information;

process a second audio synthesis parameter using a second audio processing element of the hardware unit to generate second audio information, wherein the first and second audio processing elements operate in parallel to service different ones of the audio synthesis parameters stored in the memory; and generate audio samples for the audio frame based at least in part on a combination of the first and second audio information.

42. The circuit of claim 41, the circuit being further configured to:

process a third audio synthesis parameter using a third audio processing element of the hardware unit to generate third audio information; and generate the audio samples based at least in part on a combination of the first, second and third audio information.

43. The circuit of claim 41, wherein the one or more audio files comprise musical instrument digital interface (MIDI) files, and wherein the audio synthesis parameters comprise MIDI synthesis parameters generated based on events in the MIDI files.

44. The circuit of claim 41, the circuit being further configured to combine the first and second audio information by accumulating the first and second audio information in a summing buffer.

45. The circuit of claim 41, wherein the first and second audio processing elements comprise an arithmetic logic unit that supports one or more multiply operations, one or more add operations, and one or more accumulate operations, wherein processing the first and second synthesis parameters comprises performing one or more multiply operations, one or more add operations, or one or more accumulate operations.

46. The circuit of claim 45, wherein the first and second audio processing elements also support one or more loading operations and one or more storing operations associated with a specific audio format, wherein processing the first and second synthesis parameters comprises performing one or more loading operations, or one or more storing operations associated with the specific audio format.

47. The circuit of claim 46, wherein the loading and storing operations include separate operations for a low frequency oscillator, a waveform fetch unit and a summing buffer.

48. The circuit of claim 46, wherein the specific audio format comprises musical instrument digital interface (MIDI).

49. The circuit of claim 41, wherein the first and second audio processing elements each include local registers.

50. The circuit of claim 41, the circuit being further configured to:

process a third audio synthesis parameter using the first audio processing element of the hardware unit to generate third audio information;

process a fourth audio synthesis parameter using the second audio processing element of the hardware unit to generate fourth audio information; and generate the audio samples for the audio frame based at least in part on a combination of the first, second, third and fourth audio information.

* * * * *